US007870981B2

(12) United States Patent
Ionis et al.

(10) Patent No.: US 7,870,981 B2
(45) Date of Patent: Jan. 18, 2011

(54) BRACELET DONNING ASSISTANCE DEVICE

(76) Inventors: David Ionis, 2554 30th Ave., San Francisco, CA (US) 94116; Raisa Z. Ionis, 2554 30th Ave., San Francisco, CA (US) 94116

( * ) Notice: Subject to any disclaimer, the term of this patent is extended or adjusted under 35 U.S.C. 154(b) by 0 days.

(21) Appl. No.: 12/585,953

(22) Filed: Sep. 29, 2009

(65) Prior Publication Data

US 2010/0276462 A1 Nov. 4, 2010

Related U.S. Application Data

(60) Provisional application No. 61/215,164, filed on May 4, 2009.

(51) Int. Cl.
*A47G 25/80* (2006.01)

(52) U.S. Cl. ..... 223/111; 223/120

(58) Field of Classification Search ..... 223/1, 223/120, 111; 206/6.1; 211/85.2; 248/121
See application file for complete search history.

(56) References Cited

U.S. PATENT DOCUMENTS

| | | | | |
|---|---|---|---|---|
| 2,896,890 | A | 7/1959 | Hlavac | |
| 2,926,875 | A | 3/1960 | Hoye | |
| 3,936,156 | A * | 2/1976 | Shaw et al. | 359/802 |
| 4,632,474 | A * | 12/1986 | Ingersoll | 312/305 |
| 4,650,141 | A | 3/1987 | Longo et al. | |
| 5,035,319 | A * | 7/1991 | Kunisch | 206/6.1 |
| D323,132 | S | 1/1992 | Grennan | |
| 5,741,035 | A | 4/1998 | Glass | |
| 5,785,217 | A | 7/1998 | Gorham, Jr. | |
| 5,899,369 | A | 5/1999 | Macripo | |
| 5,934,526 | A | 8/1999 | Rosenbaum et al. | |
| 6,484,910 | B1 | 11/2002 | Korkos | |
| 6,854,625 | B2 | 2/2005 | Tedeschi | |
| 7,284,684 | B1 | 10/2007 | Gharavi | |
| 7,721,924 | B2 * | 5/2010 | McCluhan | 223/111 |
| 2008/0251549 | A1 | 10/2008 | McCluhan | |

FOREIGN PATENT DOCUMENTS

| | | | |
|---|---|---|---|
| CH | 644741 | A5 | 8/1984 |

* cited by examiner

*Primary Examiner*—Shaun R Hurley
*Assistant Examiner*—Andrew W Sutton
(74) *Attorney, Agent, or Firm*—Richard C. Litman

(57) ABSTRACT

The bracelet donning assistance device is a clamping device for holding a bracelet, allowing the user to easily secure the bracelet about his or her wrist, using only his or her other hand to clasp the bracelet. The bracelet donning assistance device includes a tray having a base and at least one sidewall, defining an open interior region therein for storing jewelry. A shaft is provided, with the shaft having opposed upper and lower ends. The lower end thereof is pivotal with respect to an upper surface of the base of the tray. Additionally, a clamp is secured to the upper end of the shaft for releasably holding the bracelet. A pair of lids are pivotally secured to the at least one sidewall for releasably covering and sealing the open interior region of the tray.

18 Claims, 4 Drawing Sheets

BRACELET DONNING ASSISTANCE DEVICE

CROSS-REFERENCE TO RELATED APPLICATION

This application claims the benefit of U.S. Provisional Patent Application Ser. No. 61/215,164, filed May 4, 2009.

BACKGROUND OF THE INVENTION

1. Field of the Invention

The present invention relates to jewelry storage boxes and jewelry donning devices, and particularly to A bracelet donning assistance device that provides a clamping device for holding a bracelet, allowing the user to easily secure the bracelet about his or her wrist, using only his or her other hand to clasp the bracelet.

2. Description of the Related Art

Bracelets and other wrist-mounted jewelry, such as watches or the like, are commonly worn on one or both wrists of an individual. Bracelets, in particular, often include a fastener having a first member located at one end of the bracelet, and a second member located at the other end of the bracelet. The first member and the second member can be releasably connected together to attach the bracelet around the wrist of the individual.

A wide variety of fasteners exist for connecting the ends of the bracelet together. For example, one type of fastener includes a loop or ring at one end, and a clasp or clip at the other end. To connect the clasp to the loop, a small tab protruding from the clasp is depressed to open the clasp. A portion of the clasp is next inserted into the loop. The tab is then released to cause the clasp to close, fastening the clasp to the loop. Many other bracelet fastener designs are also known.

It is often difficult for the individual to fasten the bracelet about his or her own wrist due to the fact that only one hand is available to perform the necessary operations. It would be desirable to provide a tool that assists an individual in fastening bracelets, wrist-worn ornamentation, or other devices.

Thus, a bracelet donning assistance device solving the aforementioned problems is desired.

SUMMARY OF THE INVENTION

The bracelet donning assistance device is a clamping device for holding a bracelet, allowing the user to easily secure the bracelet about his or her wrist, using only his or her other hand to clasp the bracelet. The bracelet donning assistance device includes a tray having a base and at least one sidewall, defining an open interior region therein for storing jewelry. A shaft is provided, with the shaft having opposed upper and lower ends. The lower end thereof is pivotally secured to an upper surface of the base of the tray.

Preferably, the shaft is slidably received within a hollow mount. The hollow mount has opposed upper and lower ends, with the lower end thereof being closed and the upper end thereof being open. The lower end of the hollow mount is pivotally secured to the base. Further, an interior wall may be mounted within the tray, with the lower end of the hollow mount being pivotally secured to a central portion thereof.

The shaft may be releasably angularly lockable with respect to the hollow mount. Additionally, a clamp is secured to the upper end of the shaft for releasably holding the bracelet. The clamp includes a clamp housing, a plunger slidably received within the clamp housing, and a hinged clip. The plunger is preferably spring-biased against an inner face of the hinged clip so as to releasably hold the bracelet between the inner face of the hinged clip and a front face of the plunger. A handle is mounted on the clamp housing and is secured to the plunger for selectively disengaging the front face of the plunger from the inner face of the hinged clip.

A pair of lids are pivotally secured to the at least one sidewall for releasably covering and sealing the open interior region of the tray. A central recess is formed in each of the lids to define a central opening when the pair of lids are in a closed position. The shaft extends through the central opening when the shaft is in an upright position.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
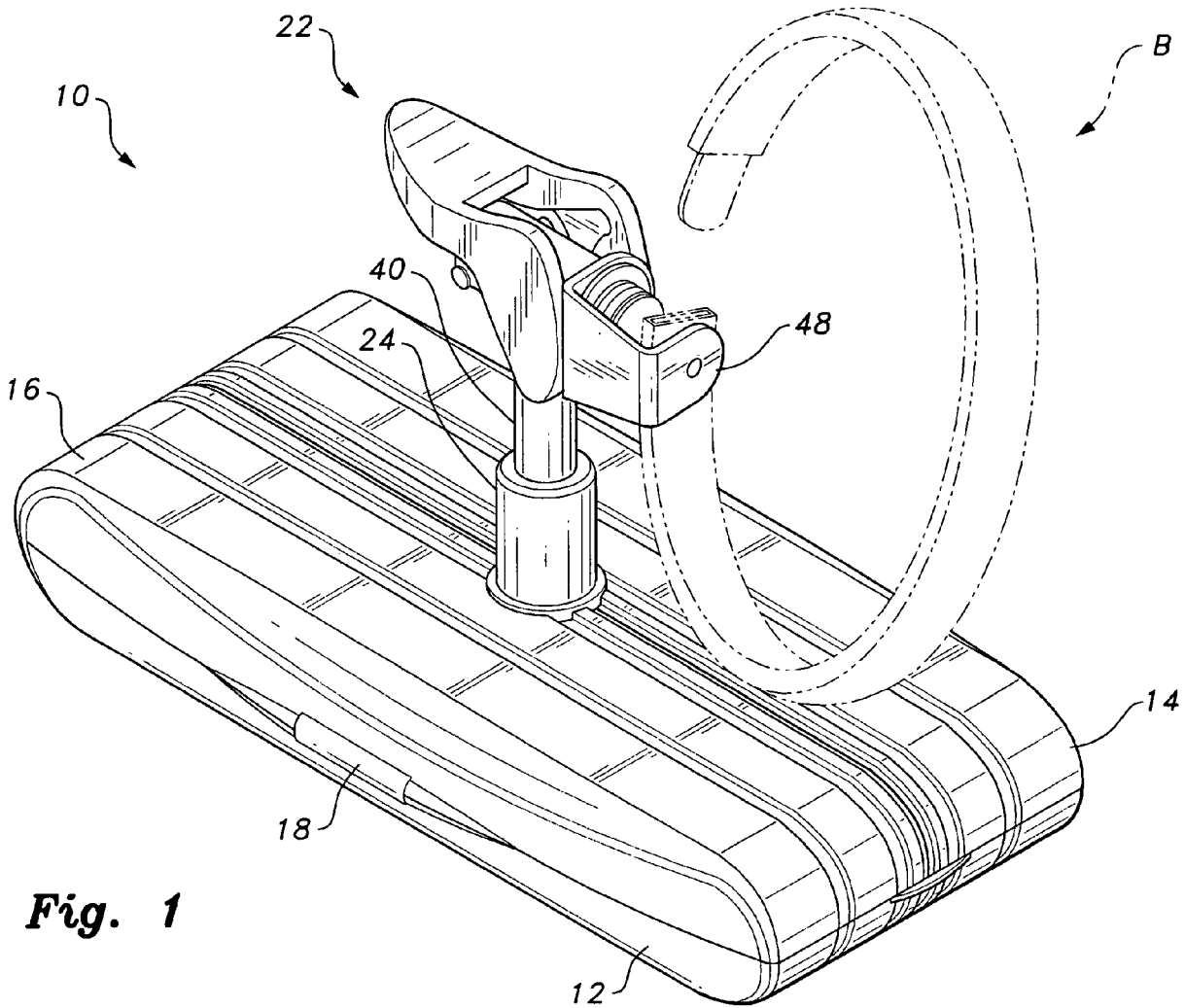
FIG. 1 is a perspective view of a bracelet donning assistance device according to the present invention.

Referring to FIG. 1, the bracelet donning assistance device 10 is a clamping device for holding a bracelet B, allowing the user to easily secure the bracelet about his or her wrist, using only his or her other hand to clasp the bracelet B. It should be understood that bracelet B is shown for exemplary purposes only and that device 10 may be used to hold any desired piece of jewelry or any other type of article that may be difficult to clasp with only one hand.

Figure 2:
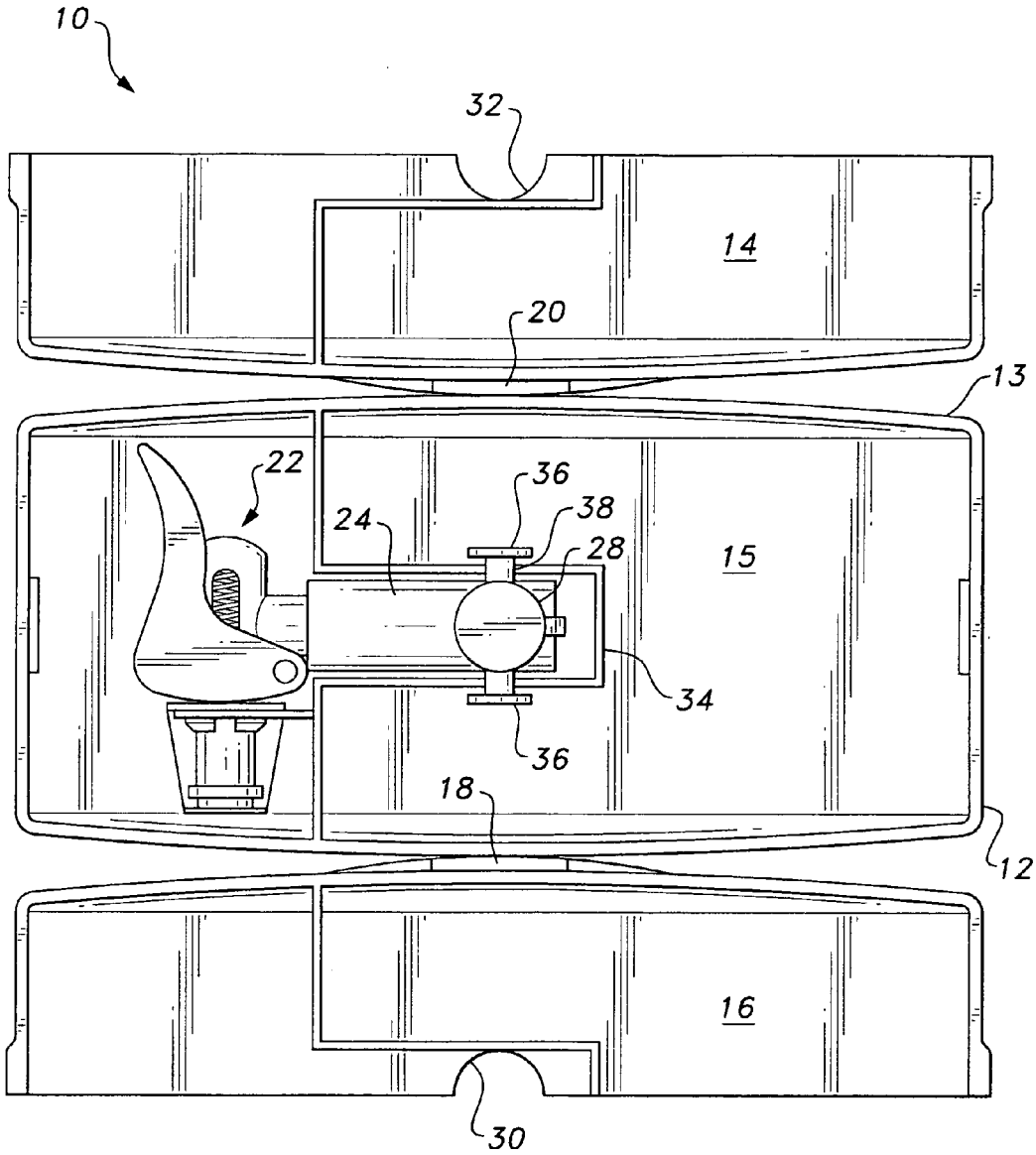
FIG. 2 is a plan view of the bracelet donning assistance device according to the present invention, shown with the lids pivoted to an open position and the clamp pivoted to a storage position within the base.
Figure 3:
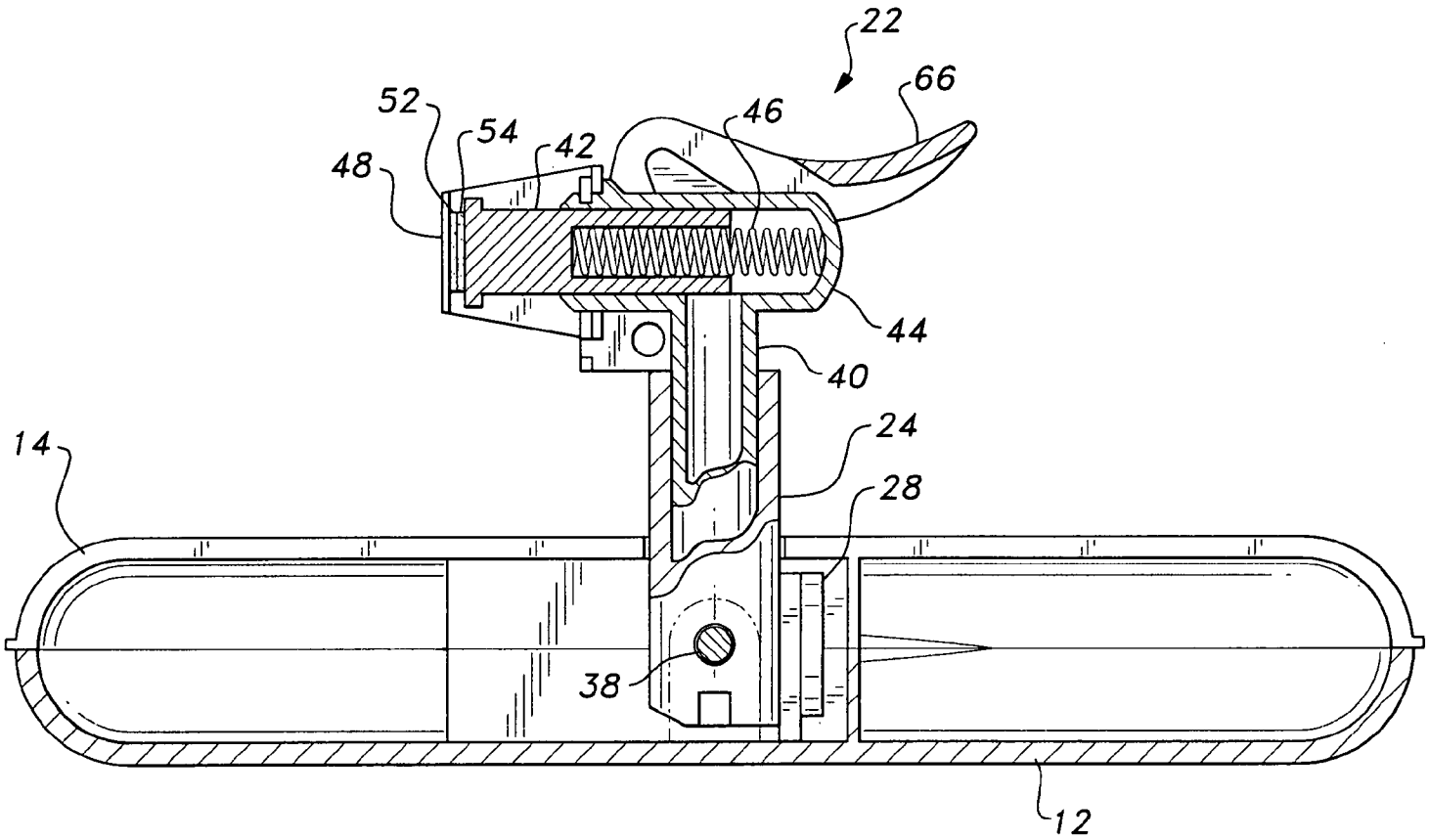
FIG. 3 is a side view in section of the bracelet donning assistance device according to the present invention.

As best shown in FIGS. 2 and 3, the bracelet donning assistance device 10 includes a tray 12 having a base 15 and at least one sidewall 13, defining an open interior region therein for storing jewelry. It should be understood that, although shown as being substantially rectangular in the drawings, the tray 12 may have any desired shape or relative dimensions. A shaft 40 is provided, with the shaft 40 having opposed upper and lower ends. The lower end thereof is pivotally secured to an upper surface of the base 15 of the tray 12.

As shown, the shaft 40 is preferably slidably received within a hollow mount 24. Although shaft 40 and mount 24 are both shown as being substantially cylindrical, it should be understood that the shaft 40 and mount 24 may have any desired shape or relative dimensions. Additionally, it should be understood that the lower end of shaft 40 may be pivotally joined to the upper surface of the base. However, in the preferred embodiment, the hollow mount 24 has opposed upper and lower ends, with the upper end thereof being open for receiving the shaft 40, and with the hollow mount 24 being pivotally secured to the base. The lower end of the hollow mount 24 is pivotally secured to the base 15, as shown.

Further, as best shown in FIG. 2, an interior wall may be mounted within the tray 12, dividing the interior of tray 12 into two separate compartments. As will be described in greater detail below, device 10 includes a clamp 22, and the clamp 22 is received within one compartment when the shaft 40 and mount 24 are in a folded configuration (shown in FIG. 2) and the other compartment remains open for receiving articles of jewelry and the like.

The lower end of the hollow mount 24 is pivotally secured to a central portion 34 of the interior wall. Preferably, as shown, the central portion 34 has a substantially rectangular configuration for receiving the hollow mount 24 when the hollow mount 24 is in the folded, storage state shown in FIG. 2. A pair of brackets 36 may further be mounted on the base 15, the brackets 36 being positioned adjacent the central portion 34 of the interior wall.

Figure 4:
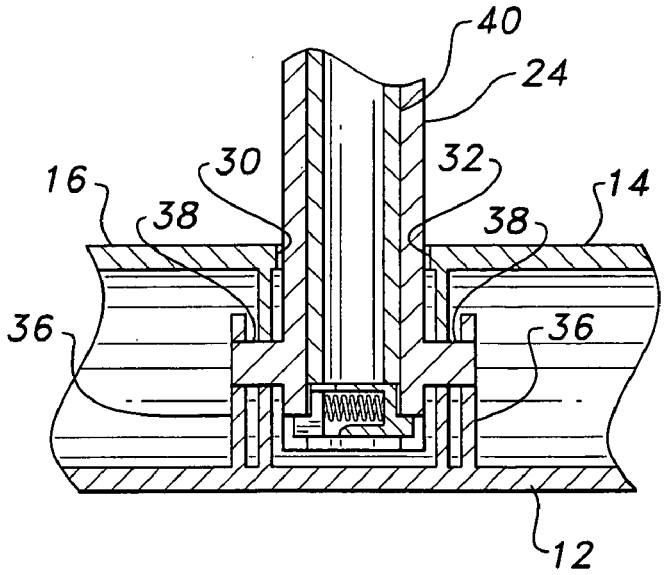
FIG. 4 is a partial transverse side view in section of the bracelet donning assistance device according to the present invention, orthogonal to the view of FIG. 3, showing pivotal attachment of a hollow mount to the tray.

Hollow mount 24 may be pivotally secured to base 15 by any suitable type of pivotal attachment. In the preferred embodiment, best illustrated in FIG. 4, a pair of posts 38 are formed on the lower end of the hollow mount 24, with the pair of posts 38 extending through a corresponding pair of apertures formed through the central portion 34 of the interior wall and pivotally engaging the pair of brackets 36.

Figure 5:
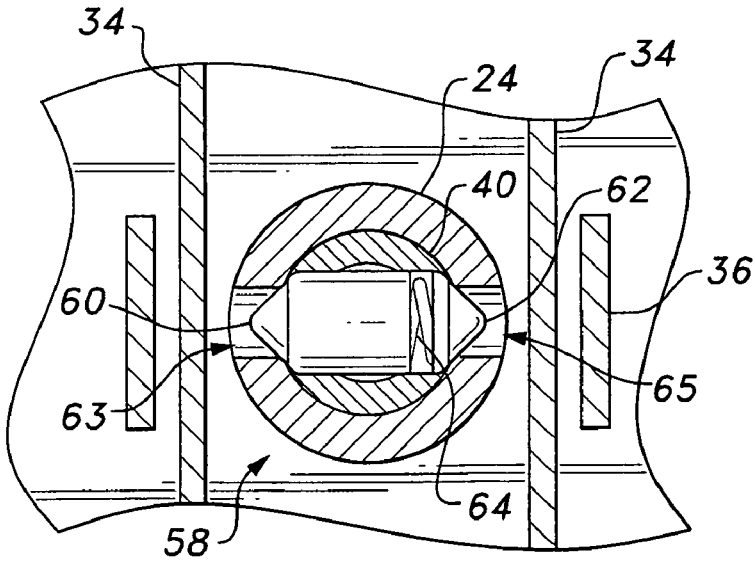
FIG. 5 is a plan view of the bracelet donning assistance device according to the present invention, shown in section through the hollow mount of FIG. 4.

As best shown in FIG. 5, the shaft 40 may be releasably angularly lockable with respect to the hollow mount 24. A spring-loaded locking pin 58 may be mounted within the shaft 40 for releasably engaging at least one opening formed through the hollow mount 24. In FIG. 5, a pair of diametrically opposed openings 63, 65 are shown, for receiving the opposed ends of locking pin 58, which are preferably configured to easily slide in and out of openings 63, 65. Locking pin 58 may include a first portion 60 for receiving a first end of spring 64 or other resilient element. A second portion 62 is mounted on the opposite end of the spring 64.

As best shown in FIG. 3, the clamp 22 is additionally secured to the upper end of the shaft 40 for releasably holding the bracelet B. It should be understood that any suitable type of clamp may be used. In the preferred embodiment, the clamp 22 includes a clamp housing 44, a plunger 42 slidably received within the clamp housing 44, and a hinged clip 48. The plunger 42 is preferably spring-biased against an inner face of the hinged clip 48 by helical spring 46 or the like to releasably hold the bracelet B between the inner face of the hinged clip 48 and a front face of the plunger 42 (as shown in FIG. 1). A handle 66 is mounted on the clamp housing 44 and is secured to the plunger 42 for selectively disengaging the front face of the plunger 42 from the inner face of the hinged clip 48. It should be understood that any suitable mechanism for easily opening clamp 22 may be utilized. A pair of pads 52, 54 may be respectively secured to the inner face of the hinged clip 48 and the front face of the plunger 42 to protect the bracelet B from damage.

As best shown in FIGS. 1 and 2, a pair of lids 14, 16 are pivotally secured to the at least one sidewall 13 of the tray 12 for releasably covering and sealing the open interior region of tray 12. As shown in FIG. 2, central recesses 32, 30 are respectively formed in each of the lids 14, 16 to define a central opening when the pair of lids 14, 16 are in a closed position.

In usage, the pair of lids 14, 16 are initially closed to cover the open interior of tray. Lids 14, 16 are pivotally secured to sidewall 13 by hinges 18, 20 or the like. When closed in the storage position, the shaft 40 is collapsed within the hollow mount 24, and hollow mount 24 is pivoted so as to rest on the upper surface of base 15, as shown in FIG. 2.

A plug 28 may be provided for releasably sealing the central opening formed through lids 14, 16 when the hollow mount 24 and shaft 40 are folded in the stored position. Plug 28 is shown in place in FIG. 2. Plug 28 is preferably joined to the hollow mount such that rotation of hollow mount 24, in the upward direction, positions the plug 28 within the storage compartment of the tray. When the hollow mount 24 is pivoted downwardly, the plug 28 is rotated to fill the opening formed between the two separate lids. The hollow mount 24 is then raised to an upright position, and lids 14, 16 are closed. The hollow mount 24 and the shaft 40 extend through the central opening formed through lids 14, 16 when in an upright position, with the lids 14, 16, in their closed state, supporting the hollow mount 24 in the upright position.

The user then rotates the clamp 22 and shaft 40 with respect to hollow mount 24 so as to angularly lock the clamp 22 into the position shown in FIG. 1 through use of locking pin 58 (thus rotating the shaft by 90 degrees) and, thus, also adjusts the vertical height of clamp 22 by sliding the shaft 40 within the hollow mount 24. This vertical adjustment allows device 10 to be easily be used by multiple users having differing heights, arm lengths and wrist sizes. By rotation of the shaft, the pin 58 engaging the openings formed through the hollow mount 24 allow for both rotational locking of the shaft 40, as well as locking the vertical position of the shaft 40. It should be understood that any suitable number of openings may be formed for the vertical positioning of the shaft with respect to the hollow mount 24. Once the clamp 22 is in place to receive bracelet B, the user engages handle 66 to slide the plunger 42 away from the hinged clip 48, and inserts the bracelet B between pads 52, 54 (which may be formed from rubber or any other suitable cushioning material). The user then allows the spring-biased plunger 42 to slide back, toward the hinged clip 48 to hold bracelet B. As shown in FIG. 1, the bracelet B is held in a substantially vertical orientation, thus preventing device 10 from sliding on a supporting surface, such as a tabletop, when the ends of the bracelet B are being fastened about the user's wrist.

After successfully clasping the bracelet B about his or her wrist, the user disengages bracelet B from clamp 22, rotates the clamp 22 and shaft 40 by disengaging the locking pin 58, and collapses the shaft 40 within hollow mount 24. The user then opens lids 14, 16 and folds the hollow mount 24 into the storage position shown in FIG. 2. The plug 28 is then positioned as shown in FIG. 2, and the lids 14, 16 are closed, with the plug 28 sealing the central opening defined by central recesses 30, 32.

It is to be understood that the present invention is not limited to the embodiments described above, but encompasses any and all embodiments within the scope of the following claims.

We claim:

1. A bracelet donning assistance device, comprising:

a tray having a base and at least one sidewall, the tray defining an open interior region;

a shaft having opposed upper and lower ends, the lower end being pivotally attached to an upper surface of the base of the tray;

a clamp attached to the upper end of the shaft for releasably holding a bracelet; and a pair of lids pivotally attached to the at least one sidewall for releasably covering and sealing the open interior region of the tray, each of the lids having a central recess formed therein to define a central opening when the pair of lids are in a closed position, the shaft extending through the central opening when the shaft is in an upright position.

2. The bracelet donning assistance device as recited in claim 1, further comprising a hollow mount having opposed upper and lower ends, the upper end thereof being open, the shaft being slidably received within the hollow mount, the lower end of the hollow mount being pivotally secured to the base.

3. The bracelet donning assistance device as recited in claim 2, further comprising an interior wall mounted within said tray, the lower end of the hollow mount being pivotally secured to a central portion thereof.

4. The bracelet donning assistance device as recited in claim 3, further comprising a pair of brackets mounted on said base and positioned adjacent the central portion of the interior wall, a pair of posts being formed on the lower end of the hollow mount, the pair of posts extending through a corresponding pair of apertures formed through the central portion of the interior wall and pivotally engaging the pair of brackets.

5. The bracelet donning assistance device as recited in claim 2, further comprising means for releasably angularly locking said shaft with respect to the hollow mount.

6. The bracelet donning assistance device as recited in claim 5, further comprising a spring-loaded locking pin mounted within said shaft for releasably engaging at least one opening formed through the hollow mount.

7. The bracelet donning assistance device as recited in claim 1, wherein said clamp comprises:

a clamp housing;

a plunger slidably received within the clamp housing; and a hinged clip, whereby the bracelet is releasably held between an inner face of the hinged clip and a front face of the plunger.

8. The bracelet donning assistance device as recited in claim 7, wherein the plunger is spring-biased against the inner face of the hinged clip.

9. The bracelet donning assistance device as recited in claim 8, further comprising a handle mounted on the clamp housing and secured to the plunger for selectively disengaging the front face of the plunger from the inner face of the hinged clip.

10. The bracelet donning assistance device as recited in claim 9, further comprising a pair of pads secured to the front face of the plunger and the inner face of the hinged clip, respectively.

11. The bracelet donning assistance device as recited in claim 10, further comprising a plug for releasably sealing the central opening of said pair of lids when the shaft is in a stored position within said tray, said plug being mounted on said hollow mount.

12. A bracelet donning assistance device, comprising:

a tray having a base and at least one sidewall, the tray defining an open interior region;

a shaft having opposed upper and lower ends, the lower end thereof being pivotally secured to an upper surface of the base of the tray;

a clamp attached to the upper end of the shaft for releasably holding a bracelet, the clamp comprising:

a clamp housing;

a plunger slidably received within the clamp housing; and a hinged clip adapted for releasably holding the bracelet between an inner face of the hinged clip and a front face of the plunger; and a pair of lids pivotally attached to the at least one sidewall for releasably covering and sealing the open interior region of the tray, a central recess being formed in each of the lids to define a central opening when the pair of lids are in a closed position, the shaft extending through the central opening when the shaft is in an upright position.

13. The bracelet donning assistance device as recited in claim 12, further comprising a hollow mount having opposed upper and lower ends, the upper end thereof being open, the shaft being slidably received within the hollow mount, the lower end of the hollow mount being pivotally secured to the base.

14. The bracelet donning assistance device as recited in claim 13, further comprising an interior wall mounted within the tray, the lower end of the hollow mount being pivotally secured to a central portion thereof.

15. The bracelet donning assistance device as recited in claim 14, further comprising a pair of brackets mounted on said base and positioned adjacent the central portion of the interior wall, a pair of posts being formed on the lower end of the hollow mount, the pair of posts extending through a corresponding pair of apertures formed through the central portion of the interior wall and pivotally engaging the pair of brackets.

16. The bracelet donning assistance device as recited in claim 15, further comprising means for releasably angularly locking said shaft with respect to the hollow mount.

17. The bracelet donning assistance device as recited in claim 16, further comprising a spring-loaded locking pin mounted within said shaft for releasably engaging at least one opening formed through the hollow mount.

18. The bracelet donning assistance device as recited in claim 17, wherein the plunger is spring-biased against the inner face of the hinged clip.

* * * * *